United States Patent [19]

Bechtiger

[11] 4,412,436

[45] Nov. 1, 1983

[54] TIME LOCK WITH ANTI-SHOCK FEATURES

[75] Inventor: Charles G. Bechtiger, La Chaux-de-Fonds, Switzerland

[73] Assignee: Sargent & Greenleaf, Inc., Nicholasville, Ky.

[21] Appl. No.: 274,273

[22] Filed: Jun. 16, 1981

[51] Int. Cl.[3] ..... E05B 43/00

[52] U.S. Cl. ..... 70/272; 70/269

[58] Field of Search ..... 70/266, 267, 268, 269, 70/270, 271, 272, 273

[56] References Cited

U.S. PATENT DOCUMENTS

| | | | |
|---|---|---|---|
| 659,445 | 10/1900 | Hollar et al. | 70/273 |
| 4,062,210 | 12/1977 | Uyeda | 70/268 |
| 4,224,814 | 9/1980 | Bechtiger | 70/272 |
| 4,269,050 | 5/1981 | Bechtiger | 70/272 |

*Primary Examiner*—Robert L. Wolfe

*Attorney, Agent, or Firm*—Mason, Fenwick & Lawrence

[57] ABSTRACT

A time lock for bank vault doors and the like having timer units of the settable dial type, a bolt controlling plunger for locking and releasing a snubber bar blocking bolt mechanism, the timer units having a release pin for releasing the blocking bolt mechanism from said locking position when the dial reaches zero time position, and a shock-resistant plunger latching mechanism which will oppose by a sufficiently high counterforce the dynamic opening forces resulting from relative movements between the timing unit release pins and the locking system during shocks, but which will not oppose by any additional counterforce the normal opening forces from the release pin during normal operation in the absence of shocks, by introducing a gear train between the locking device and a relatively small mass to increase the virtual inertia of the system, introducing what appears to be a very high mass at the input of the locking device, and providing an elastic link between the input and the mass enabling the system to absorb movements at the input by severe shocks without the output moving correspondingly.

29 Claims, 10 Drawing Figures

Fig-1
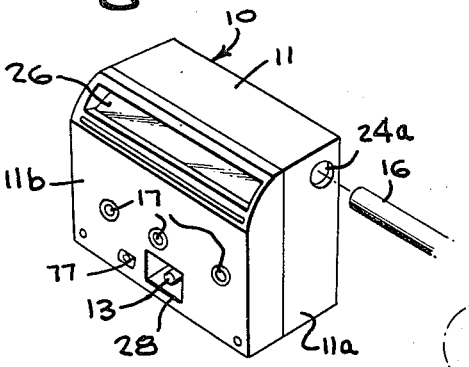
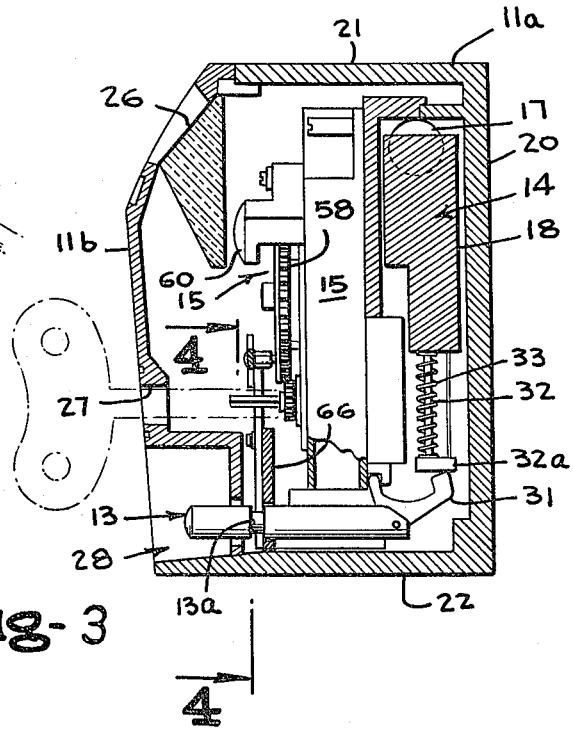
Fig-3
Fig-2
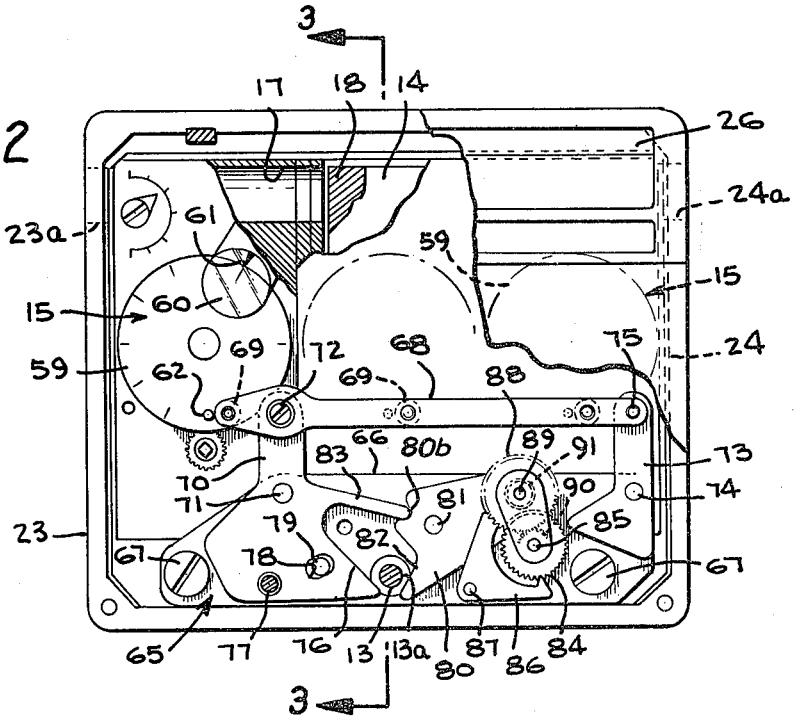

Fig-5
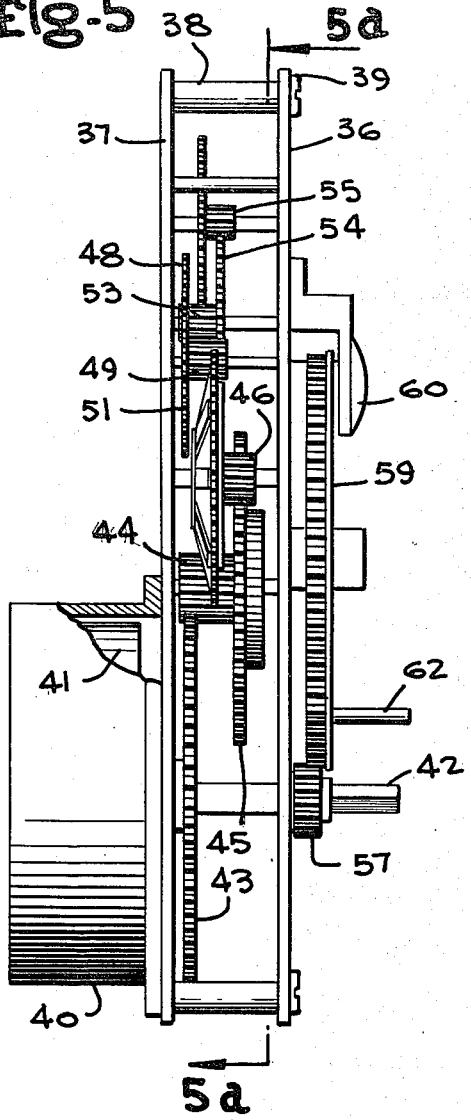
Fig-5a
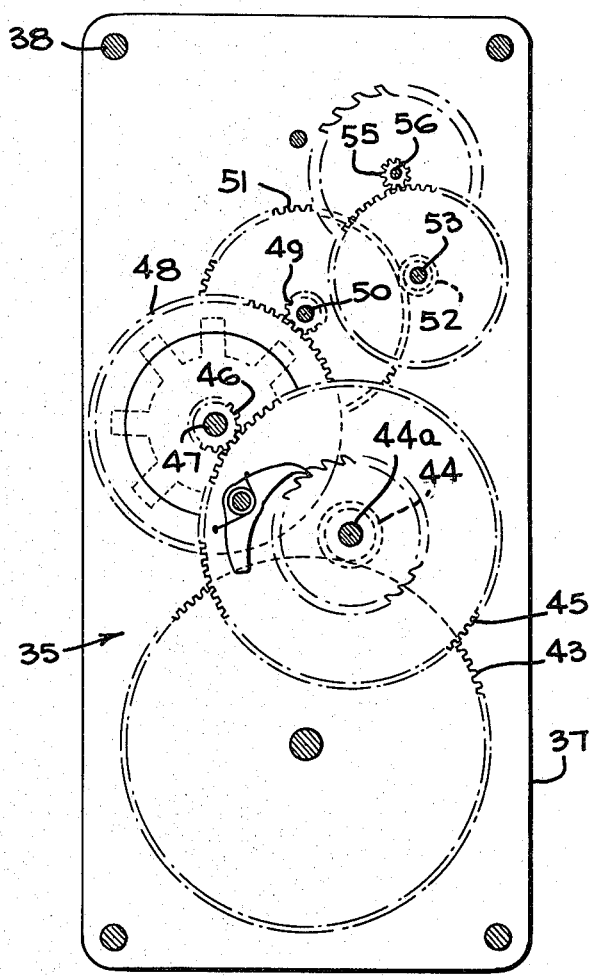
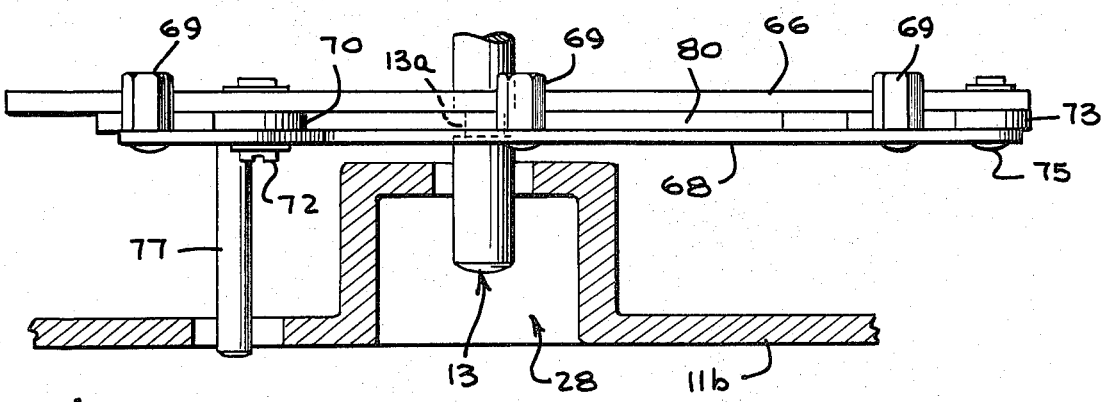
Fig-6

TIME LOCK WITH ANTI-SHOCK FEATURES

BACKGROUND AND OBJECTS OF THE INVENTION

The present invention relates in general to time locks for bank vaults and safes and similar timed high security devices for security receptacles, and more particularly to manually settable time locks provided with means for releasably holding its bolt controlling plunger against premature release from external shocks or vibrational movement imparted to the time lock, and wherein the time lock includes means which releases the plunger for unlocking movement when the timing mechanism times down to zero.

Heretofore, time locks have been in common, widespread use to place bank vaults and similar safes, security spaces, and the like in a lockout condition rendering them disabled from being opened in the normal way by bank personnel, as by proper dialing of a combination lock, during certain chosen times, such as between the bank closing time one day and its opening time the next banking day. In recent years, these time locks have customarily involved a box or case having two or three timer units or clockwork movements, to provide backup redundancy in case one or two of the timer units fail, each of which has a settable dial graduated in hours and set from a key insertable into openings in the time lock case to indicate the desired locking hours or time lapse between setting of the timer and the time of opening of the vault the next working day. Each timer unit or movement customarily has a main spring and gear system to concurrently wind the main drive spring for the clockwork mechanism and drive the dial in a windup or increasing time lapse direction relative to a stationary pointer or index mark, and the dial usually has a trip pin or stub fixed on the dial face to engage an abutment surface on the end of one of a plurality of rigid arms extending from a transversely movable carrier when the associated timer unit dial times out to zero time and moves the carrier to a release position allowing a snubber bar connected in the usual manner to the bolts for the vault door, as by connection to a common control bar for the bolts to retract to unlocking position. U.S. Pat. No. 4,062,210 granted Dec. 13, 1977 to the assignee of the present invention discloses a time lock of this general type.

Alternatively, a snap action trip arm mechanism may be provided with each timer unit to abruptly kick the carrier toward release position at zero time, as disclosed in U.S. patent application Ser. No. 940,834 filed Sept. 7, 1978 by Charles G. Bechtiger et al, owned by the assignee of the present application. The carrier typically has three of such rigid arms extending to abutment ends located at the zero time positions for the trip pins of each of the three dials of the three timer units, so that any one of the three trip pins when it engages the abutment end surface of the associated extension arm of the carrier will push the carrier toward its release position by the force of the stored energy in the associated main drive spring to unlock the time lock.

The carrier is usually only spring biased to locking position and typically moves only a short distance transversely of the time lock to effect release of the time lock, usually by withdrawing a small abutment surface bounding a slot from holding position relative to a notch or shoulder of a push lever or actuator accessible from the front of the time lock case and allowing a blocking member to drop from blocking relation to a snubber bar connected to the vault door bolts. It is possible that vibration of the time lock mechanism from various sources could cause sufficient movement of the carrier toward release position against the spring bias of the usual carrier retaining spring to effect accidental or surreptitious release of the time lock. Sidewise accelerations issuing for instance from external shocks can exert a force onto the carrier plate in the direction of making it open the lock. A force acting in a direction toward the release position of the carrier may overcome the retaining action of the carrier retaining spring. The main carrier plate in that type of prior art time locks must be strong and therefore massive because of functional requirements. The retaining spring cannot be made very strong in order not to overload the timing mechanisms when releasing. The ratio of carrier mass to retaining spring force is therefore high and cannot be reduced below a limit given by consideration of design and proper functioning. Therefore, there exists always a force of relatively small value sufficient to shift the carrier plate in the opening direction.

More specifically, the spring loaded carrier, for example as indicated at reference character 60 in said earlier U.S. Pat. No. 4,062,210, which is designed to be shifted to the unlocking or plunger release position when the dial pin or kicker arm of any one of two or three independently working time movements or timer units engage and shift the carrier, represents a heavy mass which can slide freely in the release direction, hindered only by the force of its biasing spring. Shocks severe enough and in the proper direction lead to accelerations of the carrier high enough to overcome this spring force, and thus release the plunger. Furthermore, high or severe shocks, applied in other directions than the direction of release movement of the carrier, create vibrations within the time lock structure because the components of the time lock structure are normally not rigid enough. Especially, the timing mechanisms or movements mounted on the base plate represent a very high mass which causes the base to bend for several millimeters. Instances have been observed where, after sever shocking, the apparently solid base structure of the time lock is permanently bent by as much as 5° to 10°. This implies that during a very short time, the timing mechanisms or movements, and with them, of course, their dials and release pins on the dials, undergo controllable movements relative to the base structure onto which the carrier is mounted. If shocks occur in the last thirty to sixty minutes before normal release time, the release pins on the dials, which are already very close to the carrier, may push forward because of the generated oscillations to the carrier, releasing the plunger prematurely. The concurrence of the conditions of severe shocks and short time settings has been many times observed in certain types of shock tests conducted by some authorities whose approval is required for certain types of time lock installations.

An object of the present invention is the provision of a novel mechanism for controlling latching and release of the plunger of time locks designed to overcome the above described problem, by providing a plunger latching structure which will oppose by a sufficiently high counterforce the dynamic opening forces resulting from relative movements between the timing unit release pins and the locking system during shocks, but which will not oppose by any additional counterforce the normal opening forces from the release pin during normal operation in the absence of shocks.

Another object of the present invention is the provision of a novel time lock mechanism described in the immediately preceding paragraph, wherein the high counterforces opposing the dynamic opening forces are produced in a relatively inexpensive way by introducing a gear train between the locking device and a relatively small mass to increase the virtual inertia of the system, introducing what appears to be a very high mass at the input of the locking device, and providing an elastic link between the input and the mass enabling the system to absorb movements at the input generated by severe shocks without the output moving correspondingly, the output being held back dynamically by its large virtual inertia.

Another object of the present invention is the provision of a time lock as described in the immediately preceding paragraph, wherein eccentric linking is provided between components of the latching and release mechanism enabling setting up for zero time in a quick and effective manner.

Another object of the present invention is the provision of a novel latching and releasing mechanism for the plunger of a time lock having plural time movements or timer units, wherein a base plate for the mechanism is fixed onto the base of the time lock in a non-sliding mounted relation to assure higher stability and improved precision.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of an improved time lock constructed in accordance with the present invention;

FIG. 2 is a front elevation view thereof, with portions of the front face plate structure broken away to reveal the interior mechanisms;

FIG. 3 is a vertical transverse section view, taken along the line 3—3 of FIG. 2;

FIGS. 5 and 5*a* are side elevation and section views of one of the timer units;

FIG. 6 is a horizontal section view taken along the line 6—6 of FIG. 4;

DETAILED DESCRIPTION OF A PREFERRED EMBODIMENT

Figure 4:
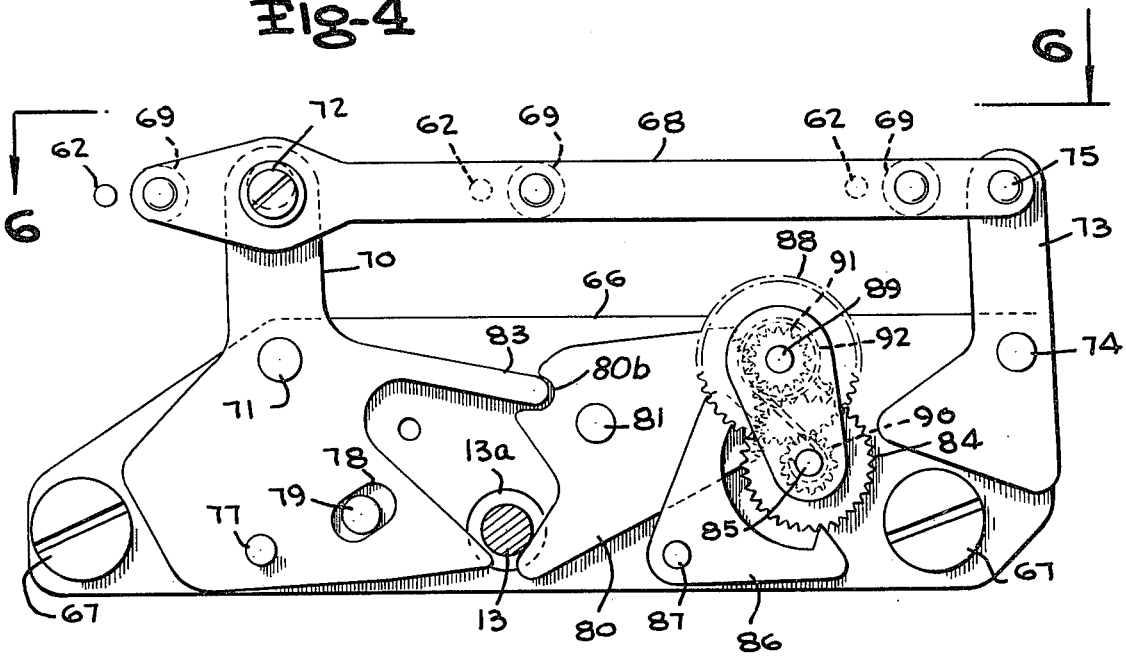
FIG. 4 is a fragmentary vertical transverse section view taken along the line 4—4 of FIG. 3, showing the principal components of the latching and release mechanism in front elevation and to enlarged scale, with the same in normal timing position latching the plunger in locked position and with the timing movement release pins spaced a short distance from the abutment studs therefor.
Figure 4A:
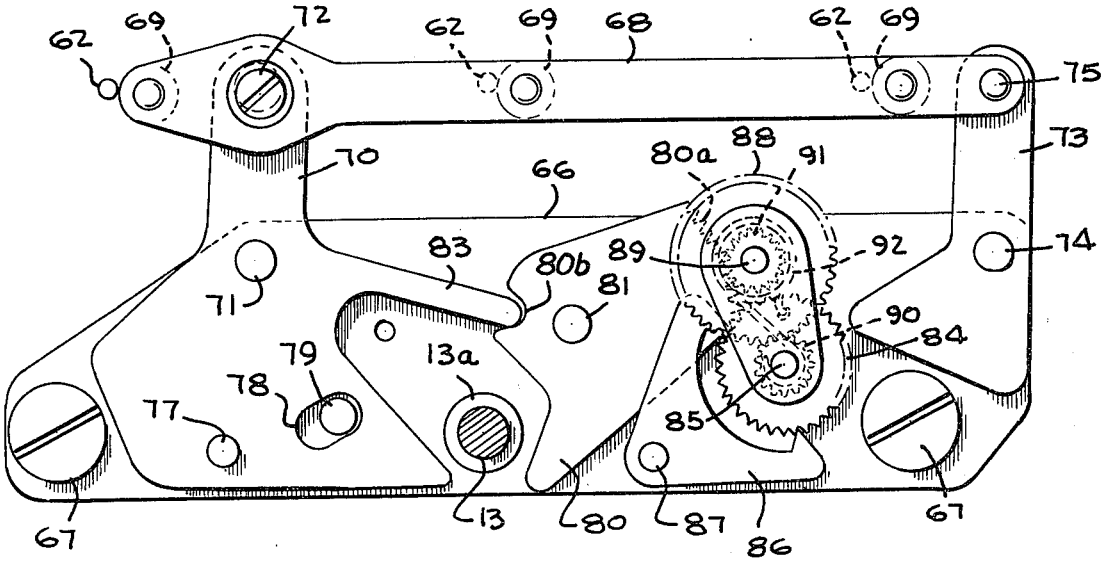
FIG. 4*a* is a view similar to FIG. 4, but showing the components in fully displaced position wherein the release pins or timing pins of the timer units have engaged the abutment studs and move them through a full release stroke.

Referring to the drawings, wherein like reference characters designate corresponding parts throughout the several figures, the time lock 10 of the present invention includes a case or housing 11 of generally rectangular, box-like form for housing the components of the time lock, which, in addition to the time movement units subsequently described, includes a push lever or plunger 13, which must be normally latched, by a subsequently described mechanism, in a locking position for holding a snubber bar blocking assembly 14 in a blocking position. The push lever 13, as will be later described in detail, is latched in a locking position at the conclusion of the working day for the bank or other establishment having the time lock controlling its vault or security area, and is released by the subsequently described latch mechanism at a predetermined time at the beginning of the next working day, under normal practices, by one of a plurality of timing movements of clockwork mechanisms, herein generally indicated by the reference character 15. In the described embodiment, two such clockwork mechanisms, time movements, or timer units 15 are provided, each having a dial pin which engages an abutment surface on an actuator push bar to shift the mechanism to release the push lever 13. While it will be appreciated that only one of such time movements or timer units 15 is required, it is customary to provide at least two such units, and sometimes three such timer units, to provide appropriate backup or redundancy in the event one of the time movements or timer units 15 fails. When the dial pin (or other type of actuator which may be provided for the timer units), of one or more of the timer units or time movements 15 times down to zero time, it engages abutment surfaces causing a latch mechanism to move to release position releasing the push lever 13 and the snubber bar blocking mechanism 14 to retract to unlocking position.

The snubber bar 16 is conventionally a horizontally disposed, cylindrical elongated rod installed on the door or wall of a safe or vault and is connected to the customary control bar coordinating locking and unlocking movements of the door bolts to move them into and withdraw them from sockets in the companion wall or door jamb portion. The snubber bar 16 conventionally includes an inner end portion which extends into a transverse horizontal cylindrical bore 17 in the time lock case 11. In the locked position of the time lock, a bolt in the shape of a block member 18 occupies the position shown in FIGS. 2 and 3 blocking the midportion of the cylindrical bore 17 so that the blocking bolt member 18 intercepts the bore 17 and blocks the snubber bar 16 in its outwardly projected or locking position. When the blocking bolt member 18 is retracted downwardly, or moved downwardly under force of gravity, upon movement of the push lever 13 to its release or outward position by transverse movement of the latching mechanism for the push lever when one of the time movements 15 times out to zero, the snubber bar 16 may then be retracted or withdrawn by the usual manual handle or lever at the exterior of the vault door to move into the portion of the bore 17 in the lock case 11 previously occupied by the blocking bolt member 18 and thus retract the control bar and withdraw the door bolts from their associated keepers to permit opening of the safe or vault door.

In one satisfactory example, the time lock case 11 may be a two-piece case formed of a main or rear housing portion 11*a* and a front cover portion 11*b*, with the main or rear housing portion 11*a* cast as a one-piece structure having a rear wall 20, top and bottom walls 21 and 22, and sidewalls 23,24. Axially aligned apertures 23*a*,24*a* are formed in sidewalls 23,24 of the case adjacent the top wall 21 aligned with the snubber bar receiving bore 17. In the illustrated example, the apertures are defined by partition formations within the housing to provide an unblocked path for receiving the snubber bar 16 for movement between projected locking position and retracted unlocking position.

The front cover portion 11*b* of the lock case 11 conventionally includes an elongated cutout window portion 26 through which the dials of the time movements or clockwork timer units 15 may be viewed, and key receiving openings 17 corresponding to the number of clockwork timer units 15 which are provided are located in the front cover 11*b* below the level of the window 26 and aligned with appropriate parts of the clockwork timer units to permit manual windup or setting of the timer units. Also, the front cover portion of the case 11 may be provided, at a location below the level of the keyholes 27, with a forwardly opening recess cavity 28 for access to the manual push lever 13 forming part of the bolt blocking mechanism permitting persons to manually push the lever 13 inwardly to place the time lock in locked condition when desired.

In the embodiment herein illustrated, the push lever 13 is a rod-like elongated cylindrical lever of circular cross-section having a circular groove 13*a* at an appropriate location between the outermost and innermost ends of the lever for latching the lever, as hereinafter described, and at its innermost or rearmost end is coupled to or coacts in a suitable way with a pivoted lever 31 or similar structure having a portion underlying and bearing against a slide rod mechanism, as indicated generally by reference character 32, extending downwardly from the blocking bolt member 18. The slide rod mechanism 32 includes a head 32*a* which is spring biased downwardly by a coil spring 33 abutting against the blocking bolt member 18.

It will be appreciated that when the lever 31 in the illustrated embodiment is in the raised position shown in FIG. 3, the contact portion of the pivoted lever 31 bearing against the head 32*a* lifts the head 32*a* to a position causing the blocking bolt member 18 to be located in raised position intercepting the bore 17, assuming the snubber bar has been shifted outwardly to projected or locking position, and thus blocks the snubber bar 16 against inward movement to the unlocking position. When the latching structure releases the push lever 13, the pivoted lever 31 will be allowed to swing downwardly to a position lowering the upper portion of the blocking bolt member 18 from its intercepted position in the bore 17 and thus permit retraction of the snubber bar to the unlocking position.

The time movements of clockwork timer mechanisms 15 are of conventional construction, usually used as two or three units in time lock mechanisms, the basic components of which are illustrated in FIGS. 4 and 5. Each of these time movements or timer clockwork mechanisms 15 include a clock gear and escapement mechanism, generally indicated at 35, together with a supporting frame formed of a pair of spaced rectangular plates, indicated herein as a front plate 36 and back plate 37, separated and fixed in essentially parallel spaced relation to each other by spacer posts 38 and screws 39. Projecting rearwardly from the back plate 37 is a spring housing or barrel 40 containing a main coil spring 41 which is wound by a key, inserted through the key receiving openings 27, having a nonround socket which interfits over a nonround main stem 42 on which the main spring 41 is mounted to windup and store energy in the main spring so as to provide the operating energy for the time movement. The clock gear train 35 includes a clockwork mechanism or drive spring main gear 43, sometimes referred to in the clockwork art as the first wheel, coupled by the interengaging gear teeth on the successive gears through a gear train including a small pinion 44 fixed on shaft 44*a* having a ratchet and pawl mechanism carried on a large gear or second wheel 45 rotatable on the shaft 44*a*. The gear 45 is coupled to a small pinion 46 on shaft 47, which in the illustrated embodiment may have a clutch mechanism associated with the large gear 48. The teeth of the third wheel or gear 48 engage a small pinion 49 on shaft 50. The shaft 50 has a large gear or fourth wheel 51 thereon which is meshed with a small pinion 52 on shaft 53, which in turn has a large gear 54 meshed with the small pinion 55 on the escapement wheel shaft 56. The escapement wheel or mechanism also includes a balance wheel in accordance with conventional practice. Thus the main spring 41 drives the main spring gear 43, which through the above described gear train and ratchet and pawl mechanism drives the shafts 44*a*, 47, 50 and 53 and the escapement wheel shaft 56 in a way such that the main spring slowly unwinds at a rate accurately controlled by the escapement mechanism, in a manner well understood in the clockmaker art. As illustrated in FIGS. 5 and 5*a*, one of the gears or wheels of the gear train 35, for example the second gear or wheel 45, is journaled for rotation on the shaft 44*a* and the ratchet wheel is fixed on the shaft 44*a* to be engaged by the tooth of the associated pawl pivoted on the gear 45 so that the gear 45 rotates only in a wind-down or counterclockwise direction as viewed in FIG. 5*a* to transfer energy stored in the main spring through the clock gear train to the escapement mechanism. The main stem 42 on which the main gear 43 for the clock gear train is fixed also has a smaller dial driving gear 57 thereon whose teeth interfit the teeth of a dial gear 58 having the dial 59 fixed against the front face of gear 58 to move therewith, causing the dial 59 to be rotated in correlated relation with the main stem 42 and clock gear train main gear 43 as the stem 42 is wound up, to set the desired time delay or time laps before the snubber bar blocking bolt member 18 is released to unlock the time lock. The dial 59 carries the usual indicia indicating the number of hours the clock is to run before activating the carrier assembly to unlock the time lock, and the usual magnifier 60 and index mark or pointer 61 may be associated with the time indicating dial 59 for easily reading the time on the dial face.

If the clock gear train 35 is made in the normal manner with the ratchet wheel fixed on the shaft 44*a* and the pawl engaging the ratchet wheel in a manner to rotate the second gear 45 only in the counterclockwise direction as viewed in FIG. 5*a*, rotation of the key and main stem 42 is possible only in a windup direction causing the dial 59 to indicate increasing or progressively greater time delay at the index marker 61. The timer unit 15 may be provided with a clutch mechanism as described in earlier patent application Ser. No. 940,834 filed Sept. 7, 1978 and assigned to the assignee of the present application, in which case, if accidental setting of the timer unit to a time delay greater than the desired number of hours has been made, the key can be manually rotated in a wind-down direction until the correct time delay is indicated at the index marker.

Figure 7:
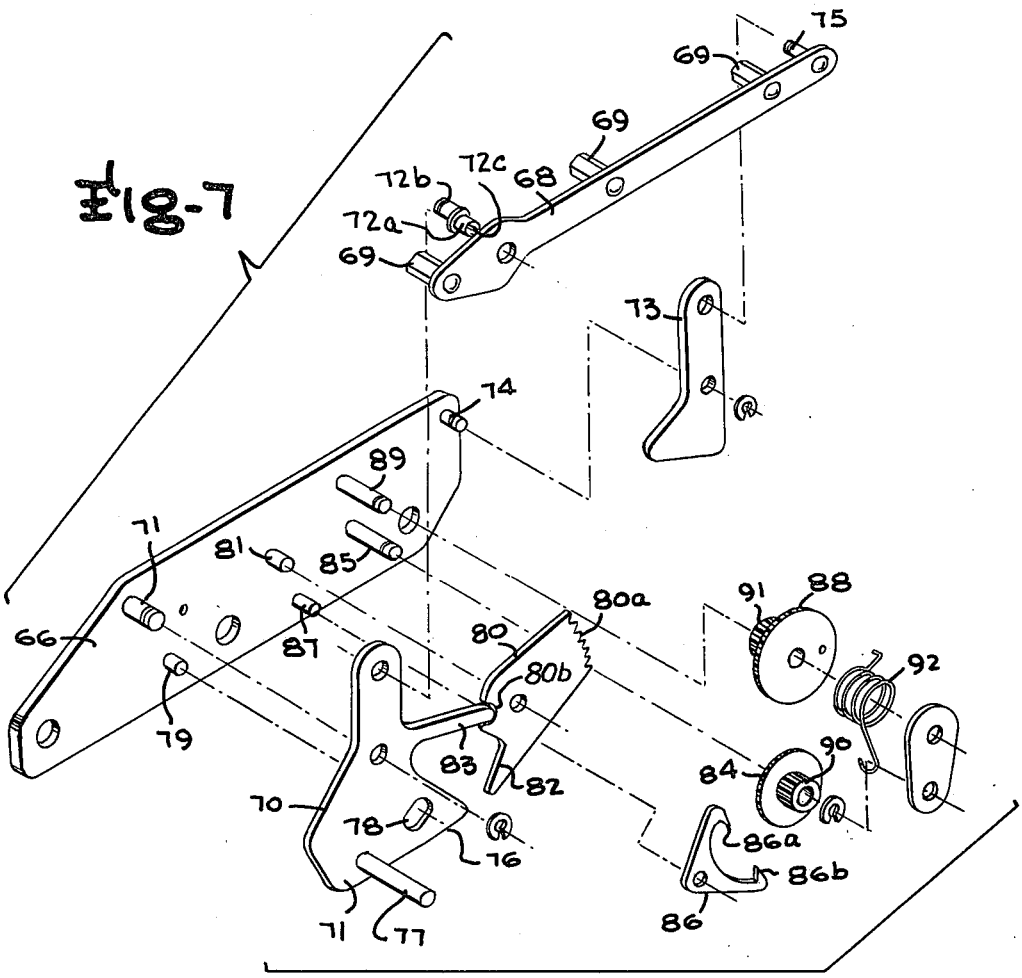
FIG. 7 is an exploded perspective view of the plunger latching mechanism components.

The shock resistant plunger latching mechanism of the present invention is best illustrated in FIGS. 2, 6, and 7, and comprises plurality of pivoted lever members and associated gears indicated generally by the reference character 65, mounted onto a rugged base plate 66 which ensures a good rigidity of the assembly. The base plate 66 which forms a supporting platform for the components of the plunger latching mechanism 65 is mounted by means of two strong mounting screws 67 extending through appropriately size holes in the base plate 66 and into threaded sockets in integral boss formations of the lock case 11.

The movable components of the shock resistant plunger latching mechanism includes motion transmission components for transmitting plunger releasing movement from the timing pins which are dynamically balanced so that the mechanism 65 itself is not shock-sensitive. These include the elongated push bar 68 transversely spanning the lower front portions of the dials 59 of the two or three time movements 15, depending on the number used, and include two or three studs or shoulder formations 69, again corresponding to the number of timer units, extending rearwardly from the push bar 68 into the paths of the timer unit release pins 62. The push bar 68 is movably supported on the base plate 66 by a pivot lever assembly resembling a pivoted parallelogram structure, comprising a latch lever 70 pivoted to the carrier plate 66 by pivot pin 71 and pivotally coupled to the push bar 68 by eccentric linking pin 72, and a companion push bar supporting lever 73 pivoted on pivot pin 74 to the base plate 66 and by pivot connection 75 to the push bar 68. The latch lever 70 includes an enlarged portion below the pivot pin 71 providing a generally triangular latching toe formation 76 having a straight edge extending substantially radially of the axis of the pivot pin 71 which projects into the annular latching groove 13*a* of the plunger 13 to normally latch the plunger 13 in locking position, and includes additionally a manual release pin 77 projecting through an opening in the front wall of the case for emergency manual release of the plunger and a movement limiting slot 78 which receives the stopping post 79 projecting through the slot 78 from the base plate 66 to define the limits of angular movement of the latch lever 70 and at the same time assuring parallel movement of 70 relative to the base plate 66. Coacting with the latching toe formation 76 of the latch lever 70 in holding the plunger in latched position is a segment gear 80 pivoted on the segment gear pivot post 81 and having a latching toe formation 82 which extends into the annular latching groove 13*a* of the plunger 13 from the side opposite the toe 76 of the latch lever. Movement of the segment gear 80 is coordinated with that of the latch lever 70 by a transmission finger or projection 83 extending integrally from the latch lever 70 and terminating in a concave recess 80*b* of the segment gear 80.

It will be apparent that release of the plunger 13 by this latching mechanism is activated by any of the timing or release pins 62 of the timer units 15 engaging and moving the associated stud or abutment shoulder formation 69 of the push bar 68 and moving the push bar 68 through its release stroke. In a preferred embodiment, the advance speed of the release pins is only about 0.54 mm per hour. Movement of the push bar 68 responsive to the force of the timing pins 62 is transmitted to the latch lever 70 pivoted about the pivot pin 71 (as well as to the companion push bar supporting lever 73), causing rotation of the latch lever 70 counterclockwise, as viewed and such movement is also transmitted by the transmission finger 83 to the segment gear 80, causing it to rotate counterclockwise about its pivot post 81, thus causing the latching toe formations 76 and 82 of the latch lever 70 and segment gear 80 to withdraw from the latching groove 13*a* of the plunger 13. When this withdrawal is complete, the plunger 13 is then pushed forward by the time lock bolt 14 which is gravitationally biased downwardly. The rotating angles of both the latch gear 70 and the segment gear 80 are limited by the stopping post 79. This transmission system results, in an illustrated embodiment, of an amplification of the advance speed from about 0.54 mm per hour up to about 1.85 mm per hour on the jaw or latching toe 82 of the segment gear 80.

In order to suppress the consequences of shocks acting on the time lock, resulting in short but strong pulses at the input to the plunger latching mechanism 75 (the push bar 68), the latching mechanism is also provided with a star wheel 84 fixed on the stub shaft 85 pivotally supported on the base plate 66, and a rotation limiting pivoted anchor member 86, acting like an escapement, pivoted on the post 87 fixed on the base plate 66 and having a pair of teeth 86*a*,86*b* to project alternately into the recesses between the teeth of the star wheel 84. The purpose of the star wheel and anchor system is to introduce a moment of inertia that the movement of the input formed by the push bar 68 and latch lever 70 have to overcome, thus absorbing the shocks. For that purpose, the movement of the push bar 68 and latch lever 70, which is transmitted to the segment gear 80 by the transmission finger 83, is transmitted by the segment gear to the anchor and star wheel system through the spring loaded toothed wheel or gear wheel 88 rotatable on shaft 89 and interfitting with teeth on the periphery of pinion 90 fixed to star wheel 84, the gear 88 also having pinion 91 whose teeth interfit with teeth 80*a* of the segment gear 80. The helical spring 92 for the spring loaded wheel 88 and mounted on the shaft 89 resets the system to its original position once the release activating force caused by the timing pins 62 has disappeared. This arrangement also has the advantage of eliminating backlash from the timing pins to the release latch.

The effect of this arrangement, with the pivoted latch lever 70 forming a pivoted link input to the system, together with a limited action spring provided by the limited inherent yielding capacity of the transmission finger 83, the reset spring 92 associated with the spring loaded wheel 88, and the effect of the star wheel 84 and escapement type anchor 86 providing what appears from the input is an extremely high mass, produces what amounts to a low pass mechanical filter suppressing the high frequency effects of shocks acting on the time lock, thus avoiding accidental release of the plunger 13. In a preferred embodiment, the angular multiplication factor of the shock resisting plunger latching mechanism 65, from the timing pin 62 to the star wheel 84, is as high as 150, which means that the input sees an inertia of $150^2$ times the inertia of the star wheel and anchor system. In the illustrated example, the timing wheel advance of 0.27 mm for a half hours time leads to a star wheel rotation of 86° of the star wheel 84. The push bar 68, latch lever 70 and latch components are dynamically balanced so as to have a neutral behavior when shocks are applied. Both the latch lever 70 and the segment gear 80 are made of hardened steel, in the preferred embodiment, in order to resist the high forces acting on the jaw or toe formations 76,82 arising from the plunger 13 striking onto these parts during shocks.

As previously mentioned, the linking pin 72 pivotally linking the push bar 68 to the upwardly projecting portion of the latch lever 70 rising from its pivot post 71 is an eccentric linking pin wherein the cylindrical forward portion 72*a* of the linking pin 72 fitted in the correspondingly sized circular opening therefor in the push bar 68 is displaced off-center or eccentrically from the rear portion 72*b* of the linking pin, which is also of cylindrical configuration and rotates in a correspondingly sized cylindrical opening in the latch lever 70. The forwardly facing portion of the linking pin 72 includes a screwdriver slot 72*c* for a screwdriver or similar adjusting tool (obviously a hexagonal slot or an Allen wrench or the like could also be used) to provide for very fine zero adjustment of the release time of the device, permitting easy horizontal displacement of the push bar 68 relative to the latch lever 70 to adapt the plunger latching mechanism to various time movements.

Figure 8:
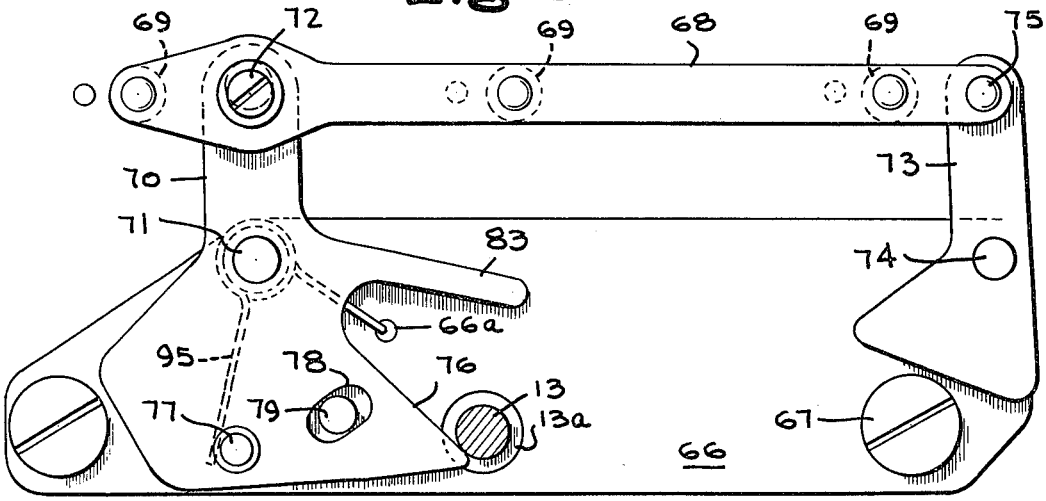
FIG. 8 is a partial front elevation of the latch lever portion of the latching and release mechanism with a modified reset spring arrangement.

It will be appreciated that where the time lock has snap-action trip arms associated with the dials of the timer units, of the type disclosed in said earlier U.S. patent application Ser. No. 940,434, which already inherently provides shock resistant control, or in cases where there are lesser requirements for the time lock as far as shock resistance is concerned, the segment gear 80, the spring loaded wheel 88 and its associated pinion 91, the star wheel 84 and its associated pinion 90, and the escapement type pivoted anchor 86 can be omitted, resulting in a considerably less expensive time lock wherein the toe formation 76 of the latch lever 70 controls the plunger 13, permitting a much less expensive time lock to be provided while still maintaining the advantages of the fine adjustment available from the eccentric linking pin 72 as well as the inherent insensitivity to shocks due to the dynamically balanced system formed by push bar 68, latch lever 70 and supporting lever 73. In such case, a reset spring, indicated in broken lines at 95 in FIG. 8, is provided, having one leg bearing against a rearwardly extending portion of the manual release pin 77 and another leg provided with a right-angled end formation located in a hole 66*a* in the base plate 66, with the spring being wound about the pivot post 71 for the latch lever 70.

What is claimed is:

1. A time lock for bank vault doors and the like having the door bolting mechanism including a snubber bar, comprising a lock case, a plurality of timer units of the settable dial type mounted in said case, a blocking member in said case movable between blocking and release positions relative to said snubber bar, an elongated plunger movable longitudinally rearwardly and forwardly of the case connected to means for holding the blocking member in blocking position and releasing it therefrom, each of the timer units having a rotatable time-lapse indicating dial and clockwork mechanism intercoupled therewith including manual setting means for rotating the dial to the desired time-lapse indication and a trip member associated with the dial for a effecting release of the blocking member when the dial reaches zero time position, an abutment bar forwardly spanning the timer units having abutments to be engaged by the respective trip members when the associated timer dial reaches zero time position for moving the abutment bar through a release stroke, a latch lever pivotally supported for movement in a plane transversely intersecting the plunger and coupled to the abutment bar, the plunger having a latching recess defining a restraining shoulder located at the transverse plane when the plunger is positioned to dispose the blocking member in blocking position, the latch lever having a latching toe interfitting in said latching recess to abut said restraining shoulder and releasibly retain said plunger in said last-mentioned position, a second lever coupled to said abutment bar defining a parallelogram type linkage therewith in coaction with said latch lever, and means at the pivotal coupling between said abutment bar and said latch lever for fine adjustment of the angular position of the latch lever relative to the abutment bar to thereby adjust the time of release stroke movement of the abutment bar by the timer trip members.

2. A time lock as defined in claim 1, wherein said last-mentioned means comprises of rotatable linking pin having cylindrical portions which are eccentrically disposed relative to each other respectively journaled in circular openings therefor in said abutment bar and latch lever whereby rotation of the linking pin by an adjustment tool varies the relative positions of the adjustment bar and latch lever.

3. A time lock as defined in claim 1, wherein a rigid base plate is fixed in the lock case in a vertical position to provide a supporting platform, means pivotally mounting said latch lever and second lever on said base plate for pivoting movement in a common plane forwardly adjacent the base plate, and said base plate having an aperture therethrough through which said plunger extends.

4. A time lock as defined in claim 2, wherein a rigid base plate is fixed in the lock case in a vertical position to provide a supporting platform, means pivotally mounting said latch lever and second lever on said base plate for pivoting movement in a common plane forwardly adjacent the base plate, and said base plate having an aperture therethrough through which said plunger extends.

5. A time lock as defined in claim 1, including shock-resisting counterforce means coupled to said latch lever forming a counterforce system therewith for opposing shock-induced releasing forces on the latch lever including a counterforce mechanism, motion transmitting means for coupling movement of said latch lever to said counterforce mechanism, and said counterforce mechanism including small-mass members for introducing a large virtual inertia to the counterforce system causing it to appear as a large mass from the abutment bar.

6. A time lock as defined in claim 2, including shock-resisting counterforce means coupled to said latch lever forming a counterforce system therewith for opposing shock-induced releasing forces on the latch lever including a counterforce mechanism, motion transmitting means for coupling movement of said latch lever to said counterforce mechanism, and said counterforce mechanism including small-mass members for introducing a large virtual inertia to the counterforce system causing it to appear as a large mass from the abutment bar.

7. A time lock as defined in claim 3, including shock-resisting counterforce means coupled to said latch lever forming a counterforce system therewith for opposing shock-induced releasing forces on the latch lever including a counterforce mechanism, motion transmitting means for coupling movement of said latch lever to said counterforce mechanism, and said counterforce mechanism including small-mass members for introducing a large virtual inertia to the counterforce system causing it to appear as a large mass from the abutment bar.

8. A time lock as defined in claim 4, including shock-resisting counterforce means coupled to said latch lever forming a counterforce system therewith for opposing shock-induced releasing forces on the latch lever including a counterforce mechanism, motion transmitting means for coupling movement of said latch lever to said counterforce mechanism, and said counterforce mechanism including small-mass members for introducing a large virtual inertia to the counterforce system causing it to appear as a large mass from the abutment bar.

9. A time lock as defined in claim 5, wherein said counterforce mechanism comprises a pivoted escaement anchor and coactive escapement wheel and a gear train for transmitting motion from said latch lever to said escapement wheel presenting a high inertia to the abutment bar and thus opposing any fast movement of the said abutment bar and latch lever.

10. A time lock as defined in claim 6, wherein said counterforce mechanism comprises a pivoted escapement anchor and coactive escapement wheel and a gear train for transmitting motion from said latch lever to said escapement wheel presenting a high inertia to the abutment bar and thus opposing any fast movement of the said abutment bar and latch lever.

11. A time lock as defined in claim 7, wherein said counterforce mechanism comprises a pivoted escapement anchor and coactive escapement wheel and a gear train for transmitting motion from said latch lever to said escapement wheel presenting a high inertia to the abutment bar and thus opposing any fast movement of the said abutment bar and latch lever.

12. A time lock as defined in claim 8, wherein said counterforce mechanism comprises a pivoted escapement anchor and coactive escapement wheel and a gear train for transmitting motion from said latch lever to said escapement wheel presenting a high inertia to the abutment bar and thus opposing any fast movement of the said abutment bar and latch lever.

13. A time lock as defined in claim 9, wherein said gear train includes a pivoted gear member having a motion transmission finger coupling with said latch member of limited inherent yielding capacity for accommodating some relative movement between the latch lever and pivoted gear member.

14. A time lock as defined in claim 10, wherein said gear train includes a pivoted gear member having a motion transmission finger coupling with said latch member of limited inherent yielding capacity for accommodating some relative movement between the latch lever and pivoted gear member.

15. A time lock as defined in claim 11, wherein said gear train includes a pivoted segment gear member having a motion transmission finger coupling with said latch member of limited inherent yielding capacity for accommodating some relative movement between the latch lever and pivoted gear member.

16. A time lock as defined in claim 12, wherein said gear train includes a pivoted segment gear member having a motion transmission finger coupling with said latch member of limited inherent yielding capacity for accommodating some relative movement between the latch lever and pivoted gear member.

17. A time lock as defined in claim 13, wherein said latching recess of said plunger is an angular channel groove transversely in circling the plunger, and said pivoted gear member includes a latching toe formation for entering said channel groove from the side opposite said latching toe of said latching lever to coact with the latter in restraining the plunger against release rsponsive to shock forces.

18. A time lock as defined in claim 14, wherein said latching recess of said plunger is an angular channel groove transversely in circling the plunger, and said pivoted gear member includes a latching toe formation for entering said channel groove from the side opposite said latching toe of said latching lever to coact with the latter in restraining the plunger against release responsive to shock forces.

19. A time lock as defined in claim 11, wherein said latching recess of said plunger is an angular channel groove transversely encircling the plunger, and said pivoted segment gear member includes a latching toe formation for entering said channel groove from the side opposite said latching toe of said latching lever to coact with the latter in restraining the plunger against release responsive to shock forces.

20. A time lock as defined in claim 12, wherein said latching recess of said plunger is an angular channel groove transversely encircling the plunger, and said pivoted segment gear member includes a latching toe formation for entering said channel groove from the side opposite said latching toe of said latching lever to coact with the latter in restraining the plunger against release responsive to shock forces.

21. A time lock for bank vault doors and the like having the door bolting mechanism including a snubber bar, comprising a lock case, a plurality of timer units of the settable dial type mounted in said case, a blocking member in said case movable between blocking and release positions relative to said snubber bar, an elongated plunger movable longitudinally rearwardly and forwardly of the case connected to means for holding the blocking member in blocking position and releasing it therefrom, each of the timer units having a rotatable time-lapse indicating dial and clockwork mechanism intercoupled therewith including manual setting means for rotating the dial to the desired time-lapse indication and a trip member associated with the dial for effecting release of the blocking member when the dial reaches zero time position, an abutment bar forwardly spanning the time units having abutments to be engaged by the respective trip members when the associated timer dial reaches zero time position for moving the abutment bar through a release stroke, a latch lever pivotally supported for movement in a plane transversely intersecting the plunger and coupled to the abutment bar, the plunger having a latching recess defining a restraining shoulder located at the transverse plane when the plunger is positioned to dispose the blocking member in blocking position, the latch lever having a latching toe interfitting in said latching recess to abut said restraining shoulder and releasibly retain said plunger in said last-mentioned position, a second lever coupled to said abutment bar defining a parellelogram type linkage therewith in coaction with said latch lever, shock-resisting counterforce means coupled to said latch lever forming a counterforce system therewith opposing shock-induced releasing forces on the latch lever including a counterforce mechanism motion transmission means for coupling movement of said latch lever to said counterfore mechanism, and said counterforce mechanism including small-mass members for introducing a large virtual inertia of the counterforce system causing it to appear as a large mass from the abutment bar.

22. A time lock as defined in claim 21, wherein said counterforce mechanism comprises a pivoted escapement anchor and coactive escapement wheel and a gear train for transmitting motion from said latch lever to said escapement wheel presenting a high inertia to the abutment bar and latch lever.

23. A time lock as defined in claim 22, wherein said gear train includes a pivoted gear member having a motion transmission finger coupling with said latch member of limited inherent yielding capacity for accommodating some relative movement between the latch lever and pivoted gear member.

24. A time lock as defined in claim 22, wherein said gear train includes a pivoted segment gear member having a motion transmission finger coupling with said latch member of limited inherent yielding capacity for accommodating some relative movement between the latch lever and pivoted gear member.

25. A time lock as defined in claim 23, wherein said latching recess of said plunger is an angular channel groove transversely in circling the plunger, and said pivoted gear member includes a latching toe formation for entering said channel groove from the side opposite said latching toe of said latching lever to coact with the latter in restraining the plunger against release responsive to shock forces.

26. A time lock as defined in claim 24, wherein said latching recess of said plunger is an angular channel groove transversely in circling the plunger, and said pivoted segment gear member includes a latching toe formation for entering said channel groove from the side opposite said latching toe of said latching lever to coact with the latter in restraining the plunger against release responsive to shock forces.

27. A time lock as defined in claim 21, wherein a rigid base plate is fixed in the lock case in a vertical position to provide a supporting platform, means pivotally mounting said latch lever and second lever on said base plate for pivoting movement in a common plane forwardly adjacent the base plate, and said base plate having an aperture therethrough through which said plunger extends.

28. A time lock as defined in claim 24, wherein a rigid base plate is fixed in the lock case in a vertical position to provide a supporting platform, means pivotally mounting said latch lever and second lever on said base plate for pivoting movement in a common plane forwardly adjacent the base plate, and said base plate having an aperture therethrough through which said plunger extends.

29. A time lock as defined in claim 26, wherein a rigid base plate is fixed in the lock case in a vertical position to provide a supporting platform, means pivotally mounting said latch lever and second lever on said base plate for pivoting movement in a common plane forwardly adjacent the base plate, and said base plate having an aperture therethrough through which said plunger extends.

* * * * *